US011950656B2

(12) United States Patent
Stanley et al.

(10) Patent No.: US 11,950,656 B2
(45) Date of Patent: Apr. 9, 2024

(54) REMOVEABLE SHOE TOE BOX INSERT

(71) Applicant: MOD WORLDWIDE, LLC, Philadelphia, PA (US)

(72) Inventors: Nina Stanley, Philadelphia, PA (US); Harsha Venna, Philadelphia, PA (US); John Stanley, Philadelphia, PA (US)

(73) Assignee: MOD WORLDWIDE, LLC, Philadelphia, PA (US)

( * ) Notice: Subject to any disclaimer, the term of this patent is extended or adjusted under 35 U.S.C. 154(b) by 0 days.

(21) Appl. No.: 17/263,369

(22) PCT Filed: Jul. 29, 2019

(86) PCT No.: PCT/US2019/043963
§ 371 (c)(1),
(2) Date: Jan. 26, 2021

(87) PCT Pub. No.: WO2020/023968
PCT Pub. Date: Jan. 30, 2020

(65) Prior Publication Data

US 2021/0289886 A1 Sep. 23, 2021

Related U.S. Application Data

(60) Provisional application No. 62/711,245, filed on Jul. 27, 2018.

(51) Int. Cl.
*A43B 7/14* (2022.01)
*A43B 7/1415* (2022.01)
(Continued)

(52) U.S. Cl.
CPC ..... *A43B 23/086* (2013.01); *A43B 7/1415* (2013.01); *A43B 7/1463* (2022.01); *A43B 7/149* (2013.01); *A43B 7/26* (2013.01)

(58) Field of Classification Search
CPC ..... A43B 7/1465; A43B 7/149; A43B 7/26; A43B 23/28
(Continued)

(56) References Cited

U.S. PATENT DOCUMENTS 2,810,214 A * 10/1957 Wolfe ..... A43B 5/12 36/8.3
5,129,165 A * 7/1992 Woodle ..... A43B 5/12 36/8.3
(Continued)

FOREIGN PATENT DOCUMENTS

WO 2014135830 A1 9/2014

OTHER PUBLICATIONS

International Search Report for PCT/US2019/043963, dated Oct. 4, 2019.

*Primary Examiner* — Sharon M Prange
(74) *Attorney, Agent, or Firm* — Nixon Peabody LLP

(57) ABSTRACT

The present disclosure is directed to a toe box insert configured to provide support between a wearer's toes and the end of a footwear. An exemplary toe box insert comprises a compressible material. The compressible material can be characterized by a firmness, a flexibility, and a springback. The firmness can provide rigidity to the footwear even when a force is applied on the toe box insert by a wearer. The flexibility can cause the toe box insert to indent in response to a force applied on the toe box insert by the wearer. The springback can cause the toe box insert to return to an original shape after a force applied by a wearer ceases.

16 Claims, 8 Drawing Sheets

(51) Int. Cl.
*A43B 7/1463* (2022.01)
*A43B 7/149* (2022.01)
*A43B 7/26* (2006.01)
*A43B 23/08* (2006.01)

(58) Field of Classification Search
USPC ..... 36/71
See application file for complete search history.

(56) References Cited

U.S. PATENT DOCUMENTS 5,740,618 A * 4/1998 Minden ..... A43B 5/12 36/71
5,791,069 A * 8/1998 Oradesky ..... A43B 23/081 36/71
6,082,027 A * 7/2000 Wagonhurst ..... A43B 3/26 36/117.6
6,705,026 B1 * 3/2004 Arbour ..... A43B 5/12 36/71
6,746,027 B1 * 6/2004 Soo ..... A43B 5/1608 280/11.19
6,810,603 B1 * 11/2004 Cosentino ..... A43B 5/12 36/8.3
7,827,707 B2 * 11/2010 Davis ..... A43B 5/12 36/71
9,380,833 B2 * 7/2016 Irving ..... A43B 7/1465
9,491,986 B1 * 11/2016 Dixon ..... A43B 7/1435
2011/0010963 A1 * 1/2011 Webb ..... A43B 19/00 36/43
2011/0047824 A1 3/2011 Davis
2011/0265348 A1 * 11/2011 Schmutte ..... A43B 7/1465 36/93
2013/0117948 A1 * 5/2013 Dorosin ..... A43B 23/086 12/128 R
2013/0298423 A1 11/2013 Daem
2015/0000159 A1 1/2015 Howlett et al.
2016/0242507 A1 * 8/2016 Dorosin ..... A43B 23/087
2021/0030105 A1 * 2/2021 Jackson ..... A43B 3/12

* cited by examiner

REMOVEABLE SHOE TOE BOX INSERT

CROSS REFERENCE TO RELATED APPLICATIONS

This application claims domestic priority under 35 U. S. C. § 119 (e) to U.S. Provisional Patent Application No. 62/711,245, entitled "REMOVEABLE SHOE TOE BOX INSERT", and filed Jul. 27, 2018. The contents of that application are hereby incorporated by reference in their entirety.

FIELD

The present invention relates to a removeable cushion for insertion into a toe box of a shoe.

BACKGROUND

Many shoes include a toe cap that defines a toe box. Typically, it is intended for an average user's toes to extend partially into the toe box, leaving a gap between the tip of the toes and the tip of the shoe. In many cases, this gap portion of the toe box is designed primarily for ornamental purposes—not to accommodate a user's toes. For example, some shoes have toe boxes with triangular-shaped or tapering portions. However, such shoes typically lack structural features to prevent the user's toes from entering the toe box further than originally intended. As a result, during walking or other activities, the wearer's foot can slide forward in the shoe, pushing the toes further into the toe box. In some instances, this results in the toes being pushed together unnaturally or at an unnatural angle. Consequently, the toes can rub against each other and against the interior sides of the shoe, leading to blisters, foot strain, and bruising of the toes.

Another issue with many toe box designs is that the gap area typically provides no support to the toe cap defining the toe box, leaving the toe cap susceptible to damage (e.g., denting, creasing, deformation, and/or tearing). This can adversely affect the aesthetics of the shoe, causing users to discard the shoes much earlier than necessary.

A common remedy to such problems is to insert cotton balls or tissue paper in the toe box for padding and support. However, such materials tend to collapse under any applied pressure. Further, these materials typically have no elasticity to retain any shape, and can only be used for an extremely short period of time. Therefore, there is a need for adequately addressing problems typically observed with toe boxes in many type of shoe designs.

SUMMARY

The various examples of the present disclosure are directed towards a toe box insert configured to be inserted into a footwear. An exemplary toe box insert, according to an embodiment of the present disclosure, comprises a compressible material. The compressible material can be characterized by a firmness, a flexibility, and a springback. The firmness can provide rigidity to a footwear even when a force is applied on the toe box insert by a wearer. The flexibility can cause an indent in the toe box insert in response to a force applied on the toe box insert by the wearer. The springback can return the compressible material to the original shape after the force applied by the wearer ceases.

In some examples of the present disclosure, the toe box insert can comprise a cover. The cover can comprise an elastic fabric configured to conform to a current shape of the compressible material.

In some examples of the present disclosure, the toe box insert can be in a triangular shape to fit in a triangular toe box, a rounded shape for a rounded toe box, or a rectangular shape for a rectangular toe box. The toe box insert can be shaped according to dimensions and a shape of a gap in a toe box of a footwear.

In some examples of the present disclosure, the compressible material can be made from at least one of a variety of materials. The variety of materials can include, but are not limited to, memory foam, charcoal memory foam, injection molded foam, a gel material, and buckwheat.

In some examples of the present disclosure, the compressible material can be configured with a plurality of layers. The plurality of layers can be in a horizontal configuration. In this horizontal configuration, each layer in the plurality of layers can have an increasing firmness. Therefore, layers closer to a vamp portion of the toe box insert can have a greater firmness than layers closer to a sole portion of the toe box insert.

In other examples, the plurality of layers can be in a vertical configuration. In this vertical configuration, each layer can have an increasing firmness. Therefore, layers of the toe box insert that are closer to a toe cap portion of the toe box insert have a greater firmness than layers closer to a heel-facing portion of the toe box insert.

In some examples, the compressible material can have a plurality of layers in a concentric configuration. In this concentric configuration, at least one first layer in the plurality of layers can extend from a vamp portion of the toe box insert to a sole portion of the toe box insert. At least one second layer in the plurality of layers can extend from the vamp portion of the toe box insert to the sole portion of the toe box insert around the at least one first layer.

In some examples, the compressible material can have a plurality of layers in a wrapped configuration. In this wrapped configuration, at least one first layer in the plurality of layers can be enclosed entirely within at least one second layer in the plurality of layers.

In some examples, the toe box insert can further comprise an adhesive material configured to attach to a footwear.

BRIEF DESCRIPTION OF THE DRAWINGS

The accompanying drawings exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

DETAILED DESCRIPTION

Figure 1A:
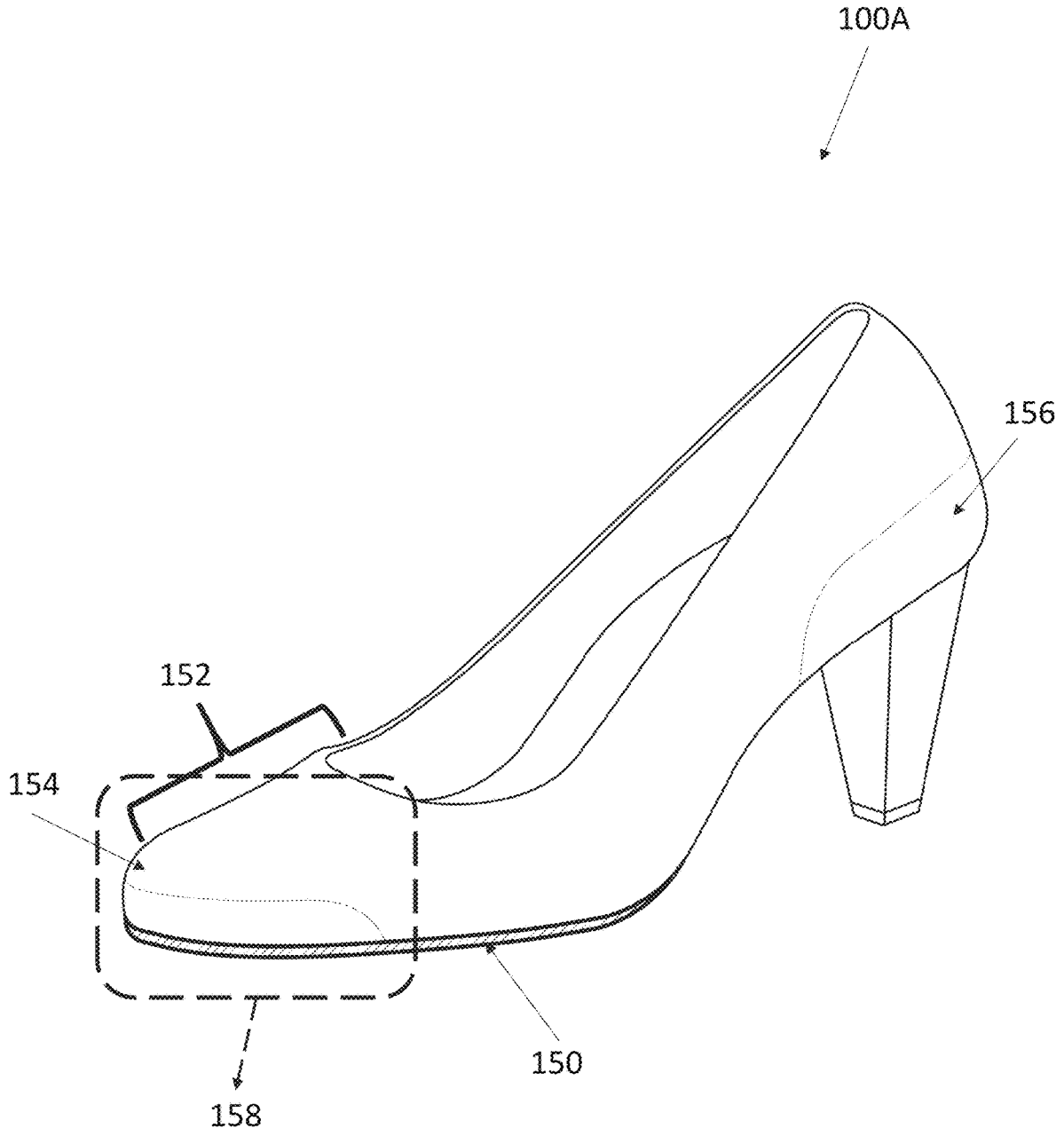
FIG. 1A (PRIOR ART)
FIG. 1A shows a footwear as known in the prior art.

The present invention is described with reference to the attached figures, wherein like reference numerals are used throughout the figures to designate similar or equivalent elements. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

The present disclosure is directed to a toe box insert configured to provide support between the tip of a wearer's toes and the toe cap of a footwear. An exemplary toe box insert comprises a compressible material. The compressible material can be characterized by a firmness, a flexibility, and a springback to prevent damage of the footwear while providing comfort to the wearer. In some examples, the toe box insert can have a cover made of an elastic fabric which conforms to a current shape of the compressible material.

FIG. 1A shows a footwear 100A as known in the prior art. Components of the footwear are labeled with respect to this FIG. 1A and will be referred to for the rest of the present disclosure. An exemplary footwear 100A can include a sole 150, a vamp 152, a toe cap 154, a heel 156, and a toe box 158. The sole 150 forms the base of the footwear 100A. The vamp 152 lies at a top of the footwear 100A and lies adjacent to the top of a wearer's foot. The toe box 158 extends from the vamp 152 to the toe cap 154 of the footwear 100A. The heel 156 forms the back of the footwear 100A and is configured to receive the heel of a foot.

Figure 1B:
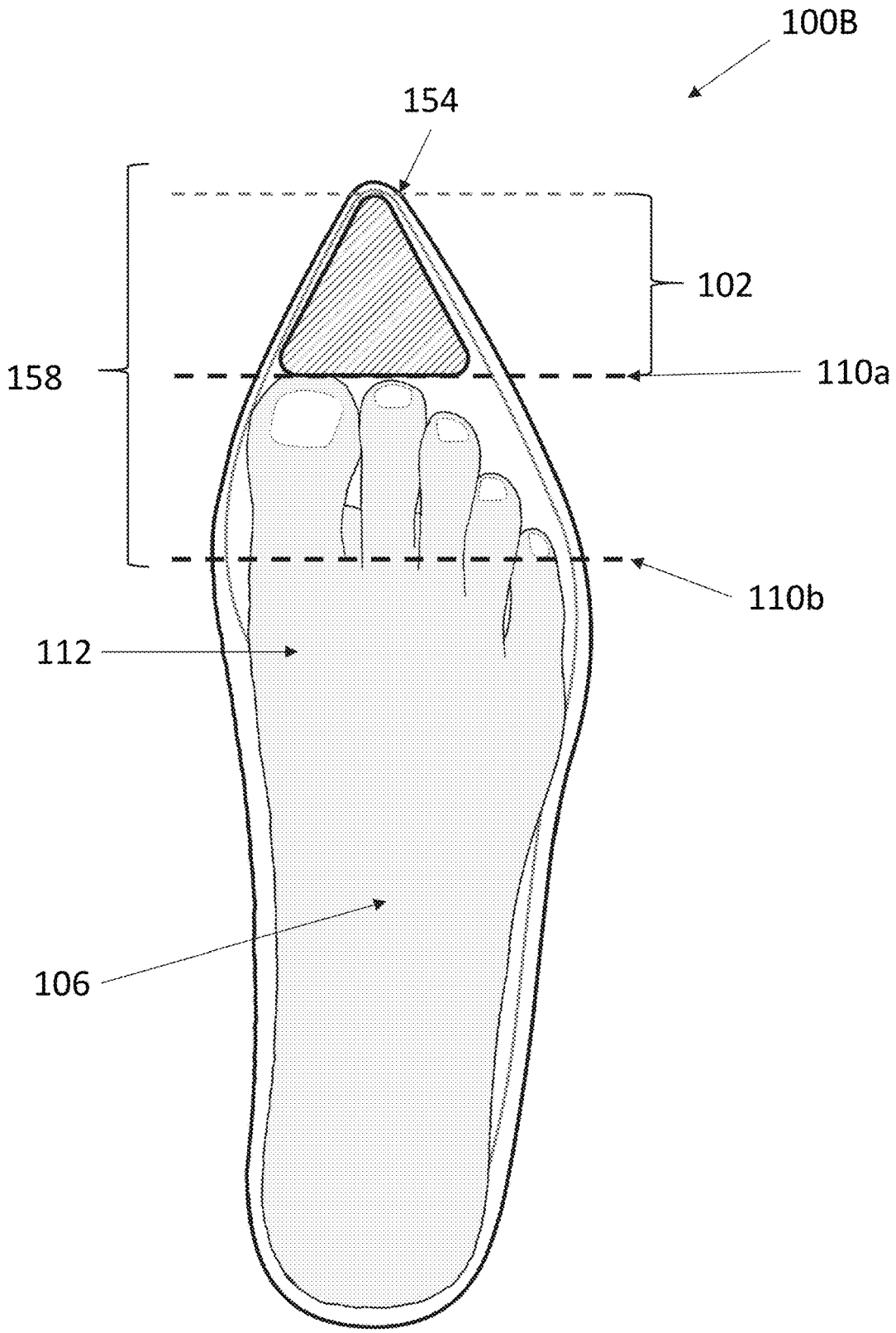
FIG. 1B shows a foot in a footwear with extra space between the tip of the wearer's toes and the toe cap of the footwear, according to a conventional footwear.

FIG. 1B shows a foot 106 in a footwear 104 with a gap 102 in the toe box 158 between the tips of the toes and the toe cap 154 of the footwear 100B. Exact dimensions and shapes of the gap 102 can vary according to the particular footwear. The gap 102 is problematic because during normal activities, a wearer's foot 106 can slide forward or backward in the footwear 100B. Consequently, the toes can slide in and out of the gap 102, causing blisters, discomfort, and/or other injury to the wearer as the foot is pushed against the sides of the footwear 100B. Moreover, blisters, discomfort, and injury can be exacerbated if gap 102 has dimensions smaller than that of the foot 106, as is the case in FIG. 1B. The risk of sliding, blisters, discomfort, and injury can be greater for certain types of footwear, especially high heel shoes.

Additionally, as noted above, footwear can crease depending on how the footwear 100B bends while the wearer is walking. For example, FIG. 1B shows two areas 110*a* and 110*b* where creases can form in the footwear 100B while in use. For example, in area 110*a*, a crease can be located at the tips of a wearer's toes and, in a second area 110*b*, a crease can form between the ball of the wearer's foot 112 and the wearer's toes. Further, due to a lack of supporting features in toe cap 154, these portions 110*a* and 100*b* of the footwear 100B are susceptible to other types of damage, such as denting or tearing.

In view of the foregoing, the present disclosure is directed to toe box inserts designed to fit into shoes of any type to provide support, comfort, and reduce injury to the wearer. These toe box inserts are also designed to minimize or eliminate creasing, denting, or other damage at the toe cap of shoes.

Figure 2A:
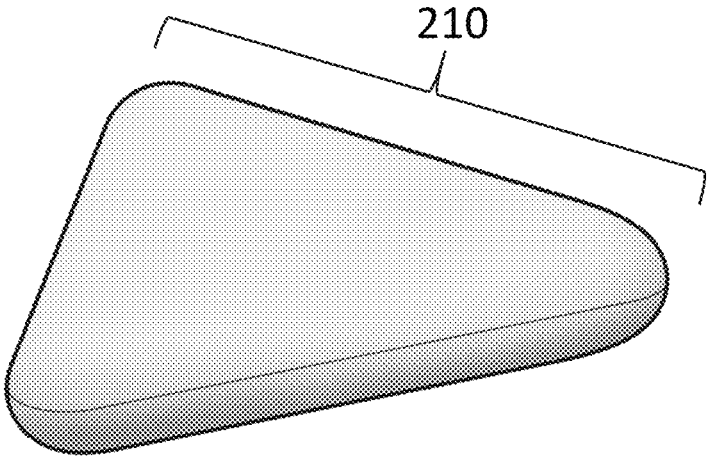
FIG. 2A shows a schematic view of an exemplary toe box insert according to an embodiment of the present disclosure.
Figure 2B:
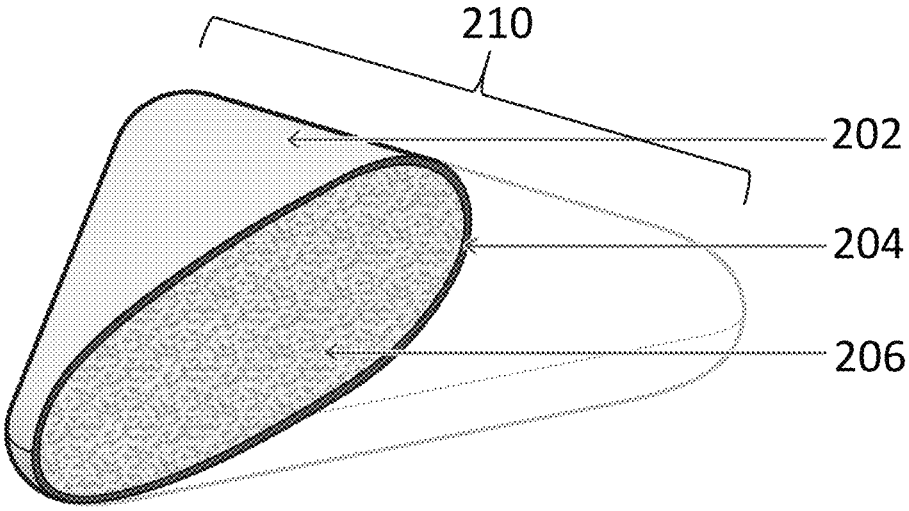
FIG. 2B shows a cross-section view of an exemplary toe box insert according to an embodiment of the present disclosure.

FIGS. 2A-2B shows a toe box insert 210 according to an exemplary embodiment of the present disclosure. FIG. 2A shows an exterior view and FIG. 2B shows a cutaway or cross-sectional view. The shape of the toe box insert 210 is designed to allow the toe box insert 210 to fit into any gap left in the toe box. Thus, the toe box insert 210 can have dimensions and shaping similar to the dimensions of the expected gap. For example, in the case of gap 102 in FIG. 1B, the toe box insert 210 can have a generally triangular shape, as illustrated in FIG. 2A, with dimensions similar to those of gap 102 in FIG. 1B. However, the dimensions of toe box insert 210 can vary depending on the size and shape of the footwear, the size of the wearer's foot, and the expected size for the gap 102.

Such a toe box insert design provides advantages over conventional methods. In particular, because the toe box insert is sized and shaped to be form-fitting for the gap 102 a proper amount of support is provided for supporting the footwear without causing discomfort or injury to the wearer.

FIG. 2B shows a cross-section view of the toe box insert 210, which is shown to include a cover 202, with a cover thickness 204, and a compressible material 206. The cover 202 can serve to protect the compressible material 206 from the wearer's toes or a footwear. The protection from the cover 202 can extend a durability of the compressible material 206.

The cover 202 can be made from a fabric with elasticity. This can ensure that the cover 202 stretches when indented by a wearer's toe and can return to an original shape when pressure is removed. The cover 202 can be made from silk, cotton, suede, or cotton blends, including lycra-cotton and spandex-cotton. However, the cover 202 can be made from any material which has an elastic nature. The elastic nature allows the cover 202 to conform to the shape of the compressible material 206 at all times without wrinkling of the cover 202. Wrinkles can be uncomfortable to a wearer and, in some circumstances, can cause blisters. Additionally, the cover 202 can be configured so that any seams are away from the toes. For example, the seams can face a toe cap of the footwear. Like wrinkles, seams can be uncomfortable to a wearer and, in some circumstances, can cause blisters.

In some implementations, a non-elastic fabric can be used for the cover 202. A non-elastic fabric, such as silk, wool, or bamboo fabric, can be chosen for comfort of the user. For example, suede provides benefits such as wicking the sweat away from the feet and making the cover 202 non-slippery to a foot.

The thickness 204 of the cover 202 can be minimized such that the wearer's toes interact mostly with the properties of the compressible material 206.

The compressible material 206 can be made from at least one of memory foam, charcoal memory foam, injection molded foam, a gel material, and activated carbon. Charcoal memory foam can be selected because it absorbs odor. One or more of these compressible materials can be additionally configured provide cooling or warmth. In some examples of the present disclosure, more than one compressible material can be used for one toe box insert. In addition to the properties listed above, these materials are selected for each having a suitable firmness, flexibility, and springback.

A proper firmness, according to an embodiment of the present disclosure, can provide a rigidity to a footwear even when a force is applied to bend the footwear. As a result, footwear is supported to resist the forming of creases. Additionally, the firmness of the compressible material 206 can provide sufficient support to prevent a wearer's foot from sliding deeper into the empty space of a footwear. Therefore, the firmness property can reduce foot strain, bruising, injury, and discomfort to the wearer.

A flexibility characteristic of the compressible material 206 allows the toe box insert to indent in response to a force applied on the toe box insert by the wearer. For example, the toe box insert can indent an amount proportional to a force placed on the toe box insert by each of the wearer's toes. For example, the wearer's largest toes cause a greater indent in the compressible material 206. Smaller toes cause a lesser indent in the compressible material. The flexibility of the compressible material 206 further allows a portion of the compressible material 206 to be indented to allow the footwear to flex normally.

A springback property allows the compressible material 206 to revert to its original shape even after receiving a great amount of force from the wearer's foot. Therefore, each of the compressible materials can spring back to an original shape after pressure from a wearer's foot flexing or the footwear.

These compressible materials are far superior to conventional methods, such as placing cotton balls in the tips of a footwear. As noted above, cotton balls, for example, quickly collapse under pressure and have no elasticity or springback properties. In contrast, compressible materials, according to various embodiments of the present disclosure, have a sufficient springback quality to provide significantly more durability than conventional padding methods.

Figure 3:
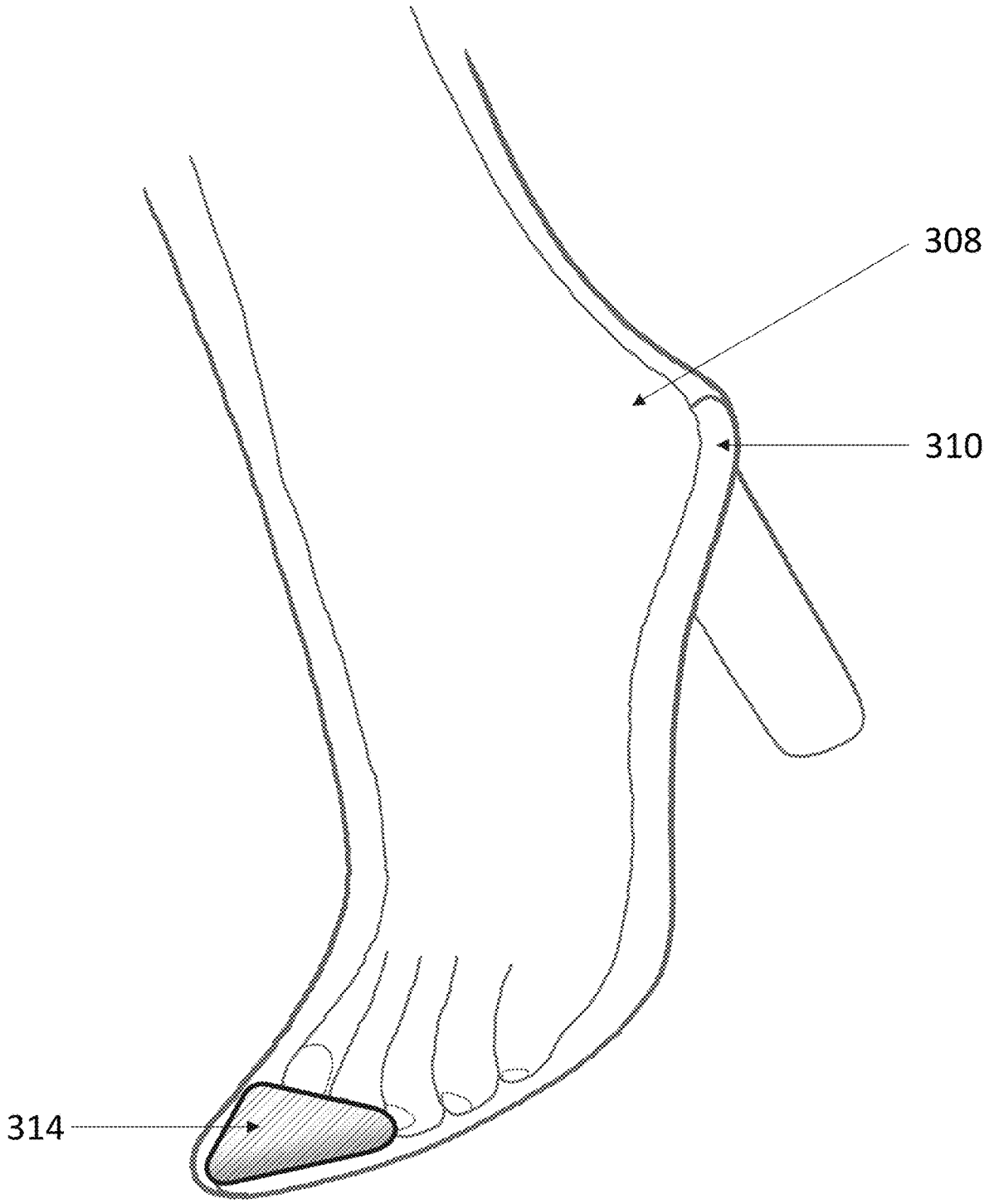
FIG. 3 shows a side view of an exemplary toe box insert in a triangular toe box high-heeled shoe, according to an embodiment of the present disclosure.
Figure 4A:
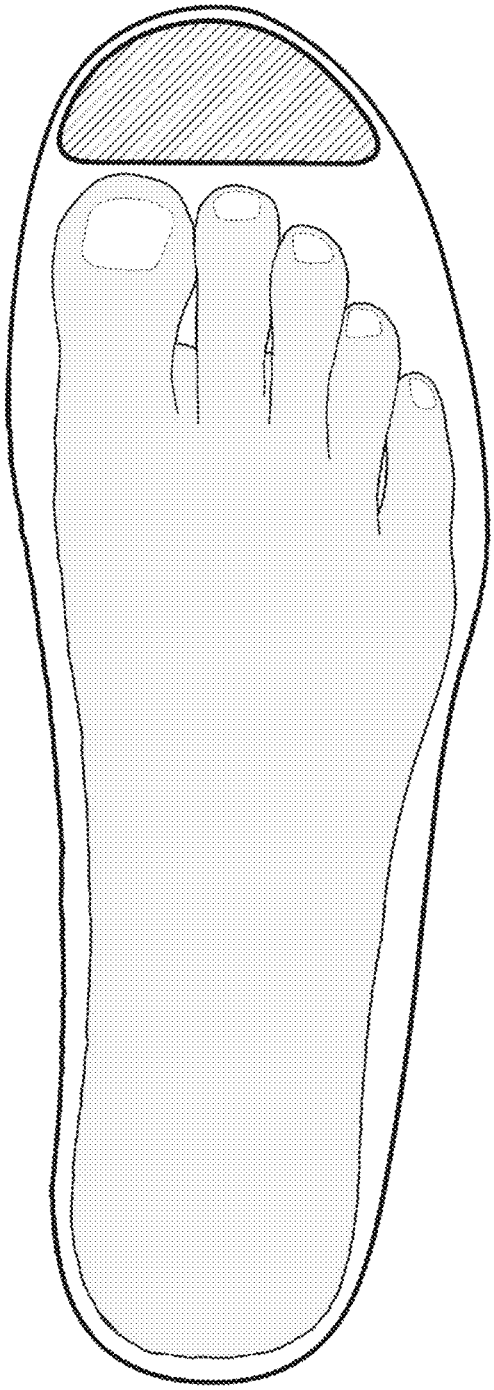
FIG. 4 shows a side view of an exemplary toe box insert in a rounded toe shoe, according to an embodiment of the present disclosure.
Figure 5:
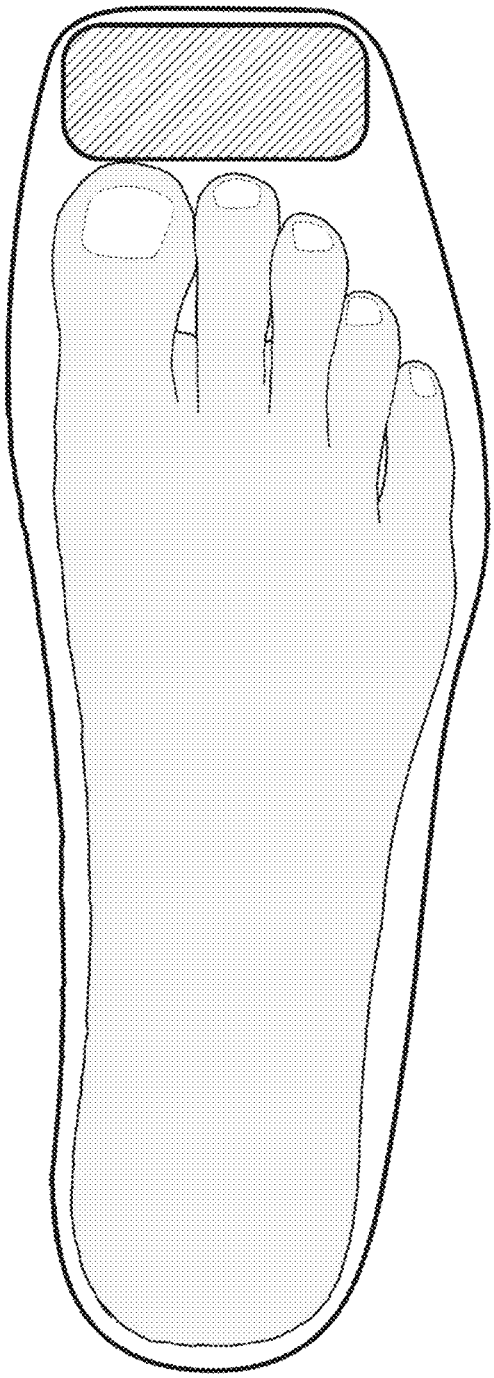
FIG. 5 shows a top view of an exemplary toe box insert in a rectangular shoe, according to an embodiment of the present disclosure.

FIG. 3 shows a side view of an exemplary toe box insert 314 in a triangular toe portion of a high-heeled shoe 310 with a wearer's foot 308, according to an embodiment of the present disclosure. FIGS. 4 and 5 show top perspectives of semi-circular and rectangular toe box inserts respectively in a semi-circular and a rectangular toe box of a shoe. FIGS. 3-5 show how the wearer's foot can no longer slide into an empty space in the footwear because the toe box insert provides a barrier between the wearer's foot and the footwear. Therefore, FIGS. 3-5 demonstrate how the wearer can have greater comfort and stability while using an embodiment of the present disclosure when wearing a footwear with a triangular toe portion.

In some examples of FIGS. 3-5, the toe box can be sufficiently large so that the wearer's toes do not press against the toe box insert. In these examples, the toe box insert can provide structural support to prevent deformation of the shoe.

FIGS. 6A-6D show exemplary configurations of the compressible material of a toe box insert when the toe box insert has a plurality of layers. These figures refer to particular regions of the toe box insert, including a top or vamp-facing portion 610, a bottom or sole-facing portion 620, a rear or heel-facing portion 630, and a front or tip-facing portion 640. The top portion 610 of the toe box insert is the part of the toe box insert configured to lie adjacent to the vamp of a footwear; the bottom portion 620 lies adjacent to the sole of a footwear; the rear portion 630 lies adjacent to the toes of a wearer; and the front portion 640 lies adjacent to the toe cap of a footwear.

Figure 6A:
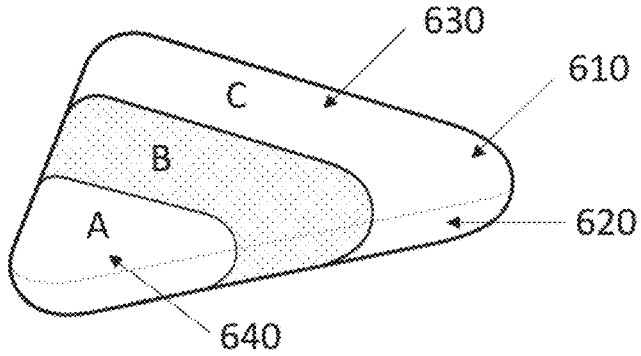
FIG. 6A shows an exemplary vertical split configuration of the compressible material of a toe box insert, according to an embodiment of the present disclosure.

FIG. 6A shows an exemplary vertical split configuration of the compressible material of a toe box insert, according to an embodiment of the present disclosure. The plurality of layers can be in a vertical configuration, where each layer in the plurality of layers runs from the top portion 610 to the bottom portion 620 of the toe box insert. Although three layers, A, B, and C, are pictured in FIG. 6A, the toe box insert can be configured with any number of vertical layers. Each layer A, B, and C in the plurality of layers can have an increasing firmness such that layers closer to a front portion 640 of the toe box insert have a higher firmness than layers closer to a rear portion 630 of the toe box insert. For example, gel can be used as the compressible material for a layer closer to a rear portion 630 of the toe box insert.

A configuration of the plurality of layers A, B, and C, as shown in FIG. 6A, can provide greater comfort to a wearer because a layer C can have a lower firmness than a layer A. Because layer C is configured to lie against the wearer's toes, the wearer can have a softer impact with the toe box insert when layer C has a lower firmness. Because layer A is configured to lie against the toe cap of the shoe, the higher firmness of layer A can help retain the triangular shape of the toe box insert and absorb greater impact while the user is walking.

Figure 6B:
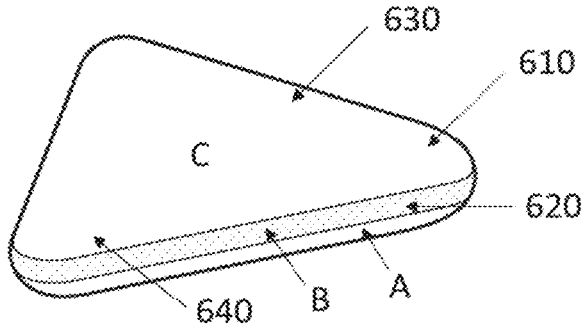
FIG. 6B shows an exemplary horizontal split configuration of the compressible material of a toe box insert, according to an embodiment of the present disclosure.

FIG. 6B shows an exemplary horizontal split configuration of the compressible material of a toe box insert, according to an embodiment of the present disclosure. The compressible material can have a plurality of layers. The plurality of layers can be in a horizontal configuration, where each layer in the plurality of layers runs from the front portion 640 of the toe box insert to rear portion 630 of the toe box insert. Although three layers, A, B, and C, are pictured in FIG. 6B, the toe box insert can be configured with any number of horizontal layers. Each layer A, B, and C in the plurality of layers can have an increasing firmness such that layers closer to the top portion 610 of the toe box insert have a higher firmness than layers closer to the bottom portion 620 of the toe box insert.

A configuration of the plurality of layers A, B, and C, as shown in FIG. 6B, can provide greater comfort to a wearer because a layer C can have a higher firmness than a layer A. Because layer A is configured to lie against the wearer's toes, the wearer can have a softer impact with the toe box insert when layer A has a lower firmness. Because layer C is configured to lie against the vamp, the higher firmness of layer C can provide a greater firmness along the vamp portion of the shoe and prevent creasing of the shoe.

Figure 6C:
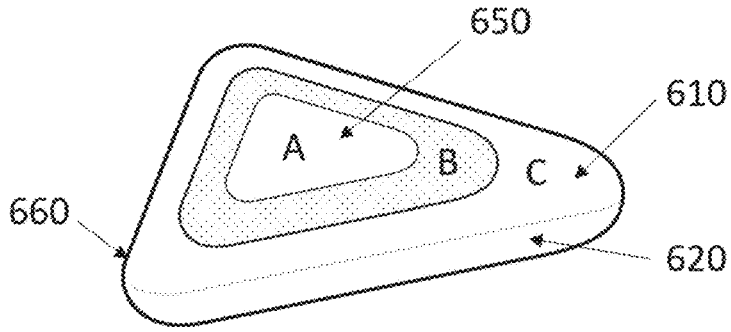
FIG. 6C shows an exemplary concentric split configuration of the compressible material of a toe box insert, according to an embodiment of the present disclosure.

FIG. 6C shows an exemplary concentric split configuration of the compressible material of a toe box insert, according to an embodiment of the present disclosure. The compressible material can have a plurality of layers. The plurality of layers can be in a concentric configuration, where at least one first layer in the plurality of layers extends from the top portion 610 of the toe box insert to the bottom portion 620 of the toe box insert. At least one second layer in the plurality of layers extends from the top portion 610 to the bottom portion 620 around the at least one first layer. For example, layer A can be a first layer completely surrounded by layer B. Layer B can be the at least one second layer completely surrounded by a layer C.

Although three layers, A, B, and C, are pictured in FIG. 6C, the toe box insert can be configured with any number of concentric layers. Each layer A, B, and C in the plurality of layers can have an increasing firmness such that layers closer to an interior portion 650 of the toe box insert have a higher firmness than layers closer to an exterior portion 660 of the toe box insert.

Because layer C is configured to have a lower firmness, layer C can be more malleable than layer A. Therefore, a more malleable layer C can allow the toe box insert to fit into a wider variety of footwear. For example, some footwear can have a larger triangularly shaped toe portion and other footwear can have a smaller triangularly shaped toe portion. A toe box insert, according to an embodiment of the present disclosure, which has an exterior portion with lower firmness can fit easily and snuggly into different sized toe portions of footwear.

Figure 6D:
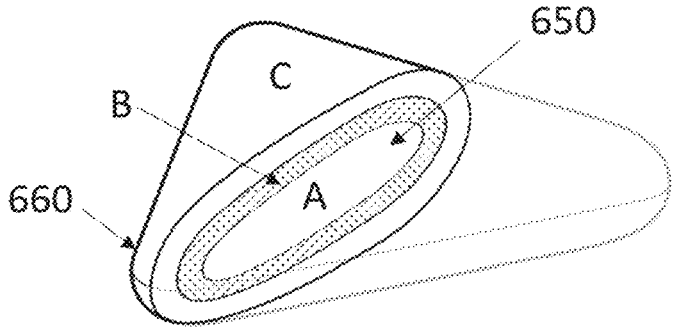
FIG. 6D shows an exemplary wrapped configuration of the compressible material of a toe box insert, according to an embodiment of the present disclosure.

FIG. 6D shows an exemplary wrapped configuration of the compressible material of a toe box insert, according to an embodiment of the present disclosure. The compressible material can have a plurality of layers in a wrapped configuration, where at least one first layer in the plurality of layers is enclosed entirely within at least one second layer in the plurality of layers. For example, layer A can be a first layer, and layer A can be completely enclosed by layer B. Layer B can be the at least one second layer, and layer B can be completely surrounded by a layer C.

Although three layers, A, B, and C, are pictured in FIG. 6D, the toe box insert can be configured with any number of wrapped layers. Each layer A, B, and C in the plurality of layers can have an increasing firmness such that layers closer to an interior portion 650 of the toe box insert have a higher firmness than layers closer to an exterior portion 660 of the toe box insert.

As with FIG. 6C, a toe box insert designed according to FIG. 6D, which has an exterior portion with lower firmness can fit easily and snuggly into different sized toe portions of footwear.

FIGS. 6A-6D demonstrate various layering of a plurality of different layers for a triangular shaped toe box insert. This layering can work similarly for a toe box insert in a rounded shape or in a rectangular shape.

Figure 7:
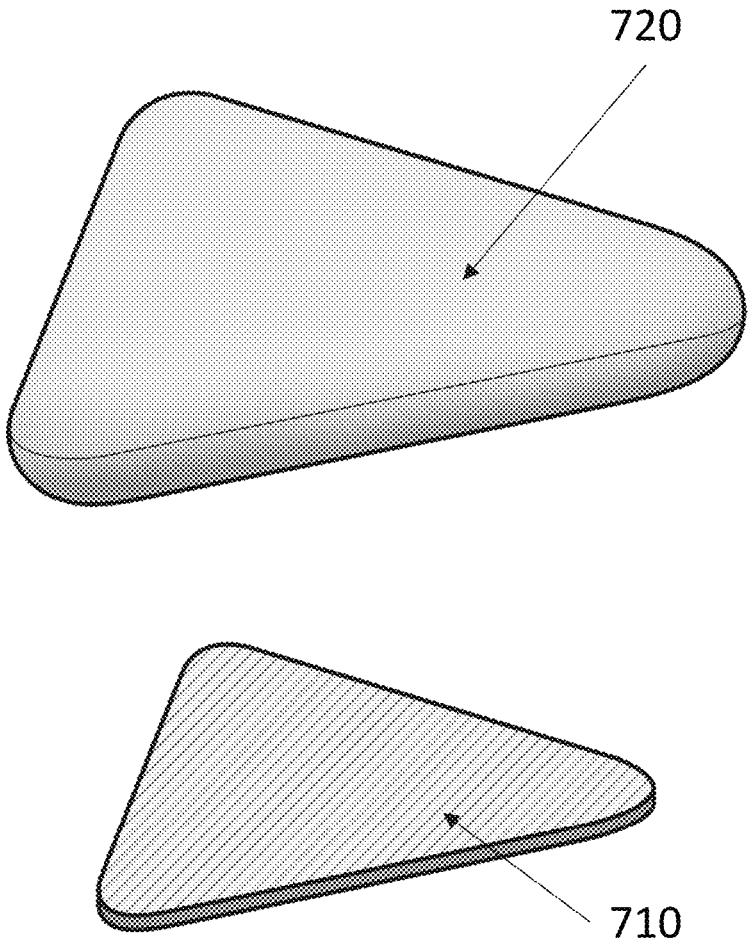
FIG. 7 shows an exemplary toe box insert with an adhesive material, according to an embodiment of the present disclosure.

FIG. 7 shows an exploded view of an exemplary toe box insert 720 with an adhesive material 710, according to an embodiment of the present disclosure. In some embodiments of the present disclosure, a toe box insert 720 can have an adhesive material 710 configured to secure the toe box insert 720 in footwear. For example, the adhesive material can be a double-sided sticker or a surface of glue on the toe box insert 720 with a peel-away cover to attach to the footwear. Although some examples of the adhesive material 710 are listed, other adhesive materials can be used as well, without limitation.

While various examples of the present invention have been described above, it should be understood that they have been presented by way of example only, and not limitation. Numerous changes to the disclosed examples can be made in accordance with the disclosure herein without departing from the spirit or scope of the invention. Thus, the breadth and scope of the present invention should not be limited by any of the above described examples. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

The terminology used herein is for the purpose of describing particular examples only and is not intended to be limiting of the invention. As used herein, the singular forms "a," "an," and "the" are intended to include the plural forms as well, unless the context clearly indicates otherwise. Furthermore, to the extent that the terms "including," "includes," "having," "has," "with," or variants thereof, are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

What is claimed is:

1. A toe box insert inserted into a footwear comprising:

a compressible material having a top portion that lies immediately adjacent to a vamp of the footwear, a bottom portion that lies immediately adjacent to a sole of the footwear, a rear portion configured to lie adjacent to toes of a wearer, and a front portion that lies adjacent to a toe cap of the footwear, wherein the compressible material is a solid structure that extends between the rear portion and the front portion, wherein the compressible material includes a plurality of layers in a horizontal configuration such that a first layer of the plurality of layers extends across the top portion and a second layer of the plurality of layers is positioned beneath the first layer, the first layer having a higher firmness than the second layer; and wherein the second layer is configured to lie adjacent to the toes of the wearer when the toes of the wearer are inserted into the footwear.

2. The toe box insert of claim 1, wherein the toe box insert is in a triangular shape configured to fit in a triangular toe box of the footwear.

3. The toe box insert of claim 1, wherein the toe box insert is in a rounded shape configured to fit in a rounded toe box of the footwear.

4. The toe box insert of claim 1, wherein the toe box insert is in a rectangular shape configured to fit in a rectangular toe box of the footwear.

5. The toe box insert of claim 1, wherein the compressible material is at least one of: memory foam, charcoal memory foam, injection molded foam, a gel material, and buckwheat.

6. The toe box insert of claim 5, wherein the compressible material is the charcoal memory foam.

7. The toe box insert of claim 1, wherein each layer in the plurality of layers has an increasing firmness such that layers closer to a vamp portion of the toe box insert have a greater firmness than layers closer to a sole of the toe box insert.

8. The toe box insert of claim 1, wherein the toe box insert further comprises an adhesive material configured to attach to a footwear.

9. The toe box insert of claim 1, wherein the toe box insert further comprises a cover, wherein the cover comprises an elastic fabric configured to conform to a current shape of the compressible material.

10. The toe box insert of claim 1, wherein the toe box insert is shaped according to dimensions and a shape of a gap in a toe box of the footwear.

11. The toes box insert of claim 1, wherein each of the plurality of layers extends from the front portion to the rear portion.

12. The toe box insert of claim 1, wherein the first layer has a first firmness configured to prevent creasing of the vamp of the footwear, and wherein the second layer has a second firmness that is lower than the first firmness and that is configured to provide a softer impact to the toes of the wearer when the toes of the wearer are inserted into the footwear.

13. The toe box insert of claim 1, wherein the plurality of layers includes a third layer, and wherein the third layer is positioned beneath the second layer.

14. The toe box insert of claim 13, wherein the first layer has a higher firmness than the third layer.

15. The toe box insert of claim 14, wherein the second layer has a higher firmness than the third layer.

16. The toe box insert of claim 13, wherein the second layer has a higher firmness than the third layer.

* * * * *